United States Patent [19]

De Abreu

[11] Patent Number: 4,830,073

[45] Date of Patent: May 16, 1989

[54] PLANING TOOL FOR A WOODWORKING MACHINE

[75] Inventor: Alfredo F. De Abreu, Trofa, Portugal

[73] Assignee: Mida-Máquinas Industriais do Ave,Lda., Trofa, Portugal

[21] Appl. No.: 233,806

[22] Filed: Aug. 19, 1988

[30] Foreign Application Priority Data

Dec. 15, 1987 [PT] Portugal ..... 86371

[51] Int. Cl.[4] ..... B27C 1/00

[52] U.S. Cl. ..... 144/221; 144/117 R; 144/230; 144/241; 407/46; 407/49; 407/63

[58] Field of Search ..... 407/46, 49, 63; 144/114 R, 117 R, 218

[56] References Cited

U.S. PATENT DOCUMENTS

| | | | |
|---|---|---|---|
| 811,768 | 2/1906 | Forbes | 144/221 |
| 3,574,251 | 4/1971 | Corti | 407/49 |
| 3,785,417 | 1/1974 | Vora | 144/221 |
| 3,868,751 | 3/1975 | Holthuis | 407/49 |
| 4,074,737 | 2/1978 | Stewart | 144/221 |
| 4,253,506 | 3/1981 | Shimohira | 144/221 |
| 4,485,858 | 12/1984 | Cecchi | 144/221 |

OTHER PUBLICATIONS

Marcoloy Carbide Cutting Tools, undated.

Quietcut TM Helical Carbide Cutterhead, Newman--Whitney, Newman Machine Company, Inc., undated.

Oliver Noise Control, Oliver Machinery Company, 1982.

"Neuartige Spiralmesserwelle für ger/e,uml/a/ us-charmes Hobeln," HGB-Mitteilungen, No. 42, 7-9/1985.

*Primary Examiner*—W. Donald Bray

*Attorney, Agent, or Firm*—Goodman & Teitelbaum

[57] ABSTRACT

The head (1) of the planing tool includes a plurality of helical grooves (2) of dovetail cross-section uniformly distributed over its periphery. Wedging devices (6) with knives (5) resting thereon are insertable sideways in the grooves. Disposed in each wedging device is a securing arrangement (7), actuation of which causes the associated wedging device-and-knife assembly to be pressed against the outwardly tapering sidewalls (17, 18) of the respective groove and held fast. Each of the knives has two opposite cutting edges (19, 20), either of which can be brought into operating position by reversing the knife. A second groove (16) runs parallel to each first groove (2) for receiving a guide component of a knife-aligning device. Owing to the helical configuration of the grooves and the precisely aligned cutting edges of the reusable knives disposed in the grooves, vibration-free machining of workpieces with planing widths of up to more than two meters is possible.

10 Claims, 2 Drawing Sheets

PLANING TOOL FOR A WOODWORKING MACHINE

Figure 1:
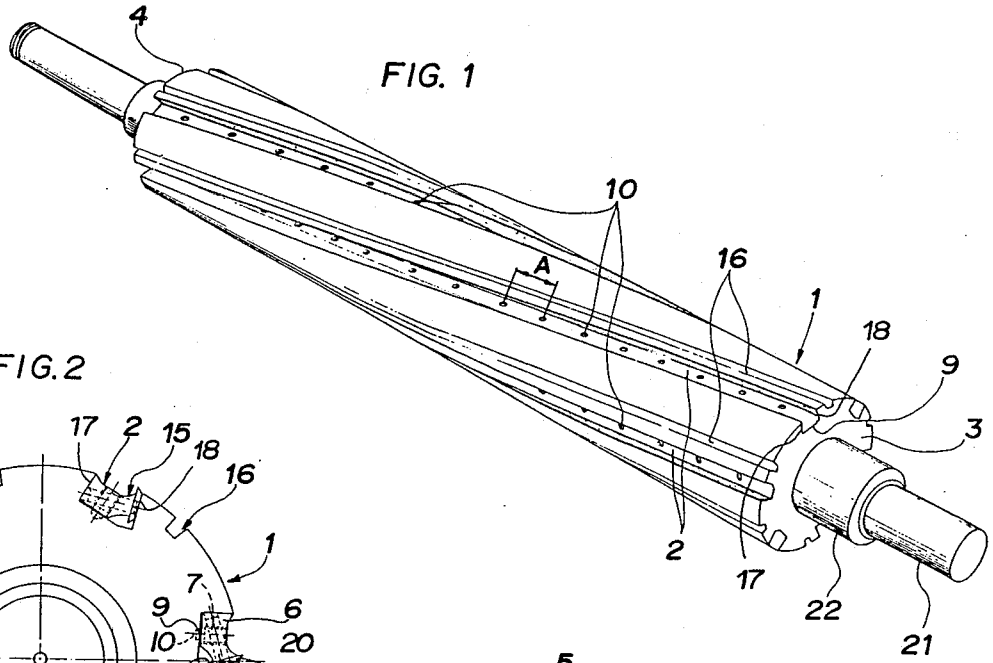

This invention relates to woodworking equipment, and more particularly to a planing tool for a woodworking machine, of the type having a substantially cylindrical head with at least one helical groove of substantially dovetail cross-section in its surface, extending from one end of the head to the other and having a bottom, two sidewalls and at least one knife disposed therein.

Planing tools for woodworking machines having cylindrical heads with several grooves in their surfaces and interchangeable cutting inserts disposed therein are commercially available and in use in conventional planing machines nowadays.

In another planing tool design, bores disposed in a pattern and distributed over the entire outer surface of a cylindrical head are provided for receiving insertable cutters. In most cases, the cutting inserts are either made in one piece or consist of carriers with knives welded on and are either bothersome to resharpen or expensive to replace.

A further prior art design of cutting inserts has interchangeable knives, each provided with several cutting edges and being wedgable in the aforementioned planer-head bores by means of a wedging device. By rotating the knives, the individual cutting edges can be brought into operating position.

In this last design, one knife after the other engages the machining surface of the workpiece through rotation of the planing tool. Especially in the case of tools intended for a large planing width, the pulsating stress on the knives results in uneven running of the tool. This has a negative effect on the quality of the planed surfaces of workpieces in that undulating traces of planing are perceivable there.

Furthermore, it is difficult and troublesome in the case of planing tools designed for large planing widths to align all the knives distributed over the head and to secure them so that they project uniformly. Poorly inserted knives bring about an inferior quality of the machined workpiece surface, as described above.

It is an object of this invention to provide an improved planing tool for woodworking machines which is designed for large planing widths but does not have the above-mentioned detrimental effects.

Another object of the invention is to provide such a planing tool in which the knives are reusable, simple to exchange, and uncomplicated to align.

To this end, in the planing tool for woodworking machines according to the present invention, of the type initially mentioned, there are blind holes spaced from one another longitudinally in the bottom of the groove, a wedging device on which the knife can be disposed and pushed into the groove from one end of the head together with the wedging device, the wedging device having a central bore, and a securing means disposed in the central bore and engageable with one of the blind holes for wedging the wedging device with the knife resting on it fast against the sidewalls of the groove.

Because there are a number of helical grooves on the surface of the head of the inventive planing tool, extending from one end of the head to the other and regularly distributed over its circumference, any pulsating stress on the knives secured in the grooves is avoided. Instead of a single knife disposed in each of the grooves and extending over the entire length of the groove, there are a number of small, adjacent, contiguous, individually secured knives in each of the grooves. Second grooves disposed parallel to the first grooves are provided for receiving a guide component of a knife-aligning device. The cutting levels of the individual knives can thereby be equalized with one another and identically adjusted without any great expenditure of energy. The individual knives of two neighboring grooves are mutually offset by half a knife-width. Owing to these features of the inventive planing tool, smooth running of the tool, and consequently a high-quality, immaculate surface of the machined workpiece, is achieved even with operating widths of over two meters.

A further advantage of the invention is that the small knives take the form of double-edged disposable blades, thus eliminating costly resharpening. Moreover, cemented-carbide knives, e.g., of tungsten carbide, or diamond knives can be utilized.

A preferred embodiment of the invention will now be described in detail with reference to the accompanying drawings, in which:

FIG. 1 is a perspective view of the inventive planing tool without the knives and wedging devices inserted.

Figure 2:
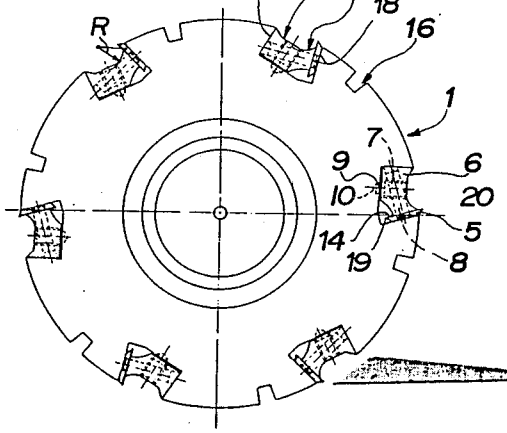
Figure 3:
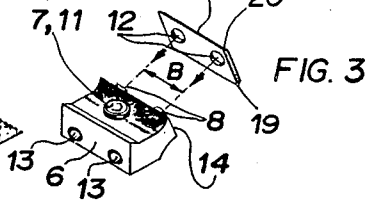
Figures 4, 5:
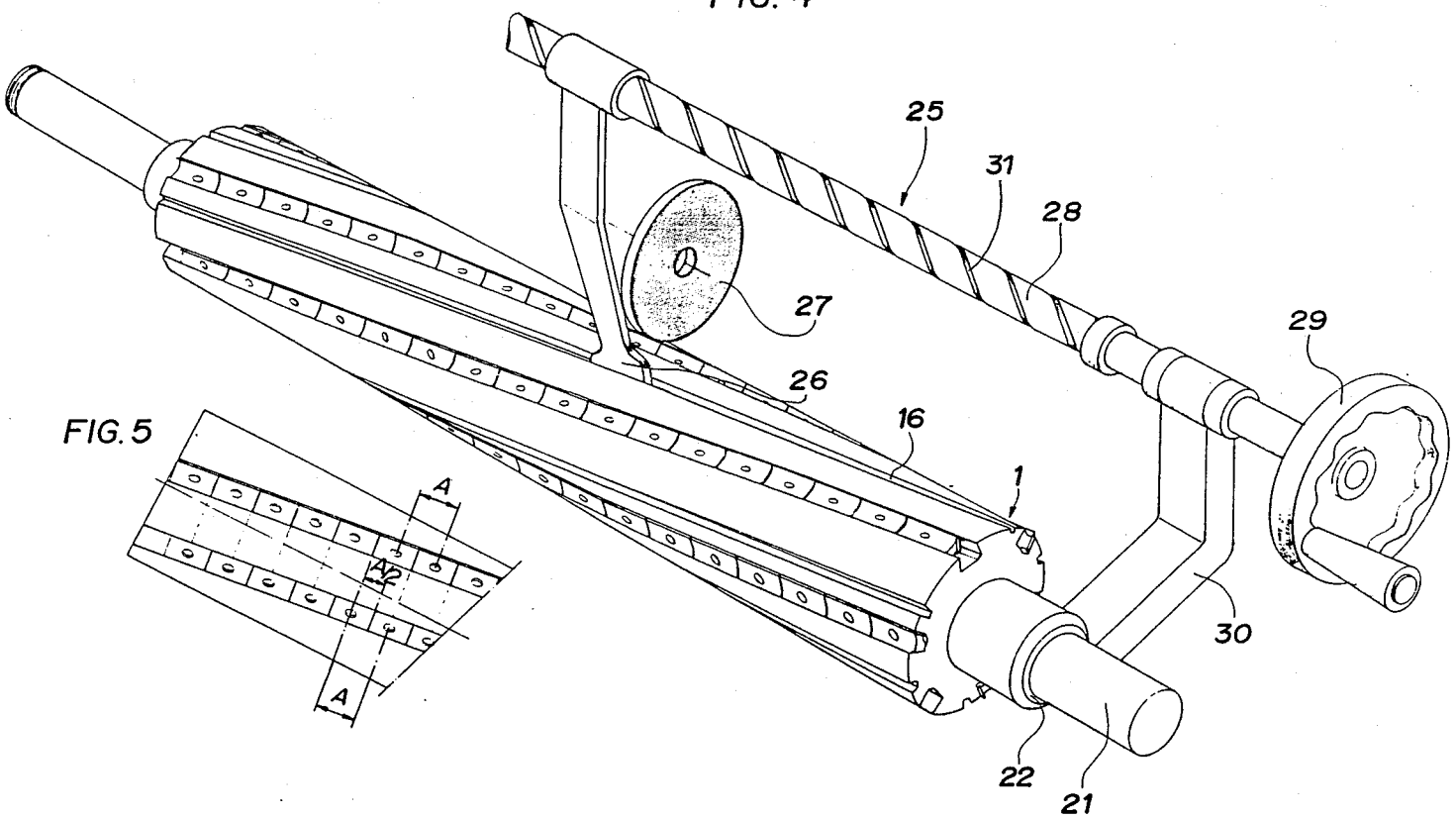

FIG. 2 is an end-on elevation of the planing tool with knives and wedging devices disposed in the grooves and with the second grooves for guiding the knife-aligning device, FIG. 3 is an exploded perspective view of a single wedging device with an associated knife, FIG. 4 is a perspective view of the tool with a knife-aligning device positioned thereon, and FIG. 5 is a diagrammatic view showing the manner in which the individual knives in adjacent grooves are staggered.

FIG. 1 shows the substantially cylindrical head 1 of the inventive planing tool. At each of the ends 3, 4 of the head 1 there are concentric journals 21, 22, the purpose of which is to mount the planing tool rotatingly in bearing means (not shown). Uniformly distributed over the peripheral surface of the head 1 are grooves 2, each of which has a substantially dovetail cross-section, two sidewalls 17, 18, and a bottom 9 including blind holes 10 spaced from one another at intervals A along the groove 2. The holes 10 are used for positioning and immobilizing wedging devices not shown in this drawing figure. Running parallel to each groove 2 is a second groove 16 of substantially rectangular cross-section intended to receive a guide component 26 of a knife-aligning device (FIG. 4).

In FIG. 2, the inventive planing tool is seen in an end-on elevation. Secured in the grooves 2 by means of wedging devices 6 and securing means 7 are knives 5. The wedging device 6 has for this purpose a central bore 11, provided in the embodiment illustrated with an internal thread, in which a securing means is disposed, e.g., a headless screw 7 with a shoulder affixed at one end. The shoulder is designed to fit into one of the blind holes 10 in the bottom 9 of the groove 2. By turning the screw 7 clockwise, the wedging device 6, with the knife 5 resting against a contact surface 14, is pressed against the outwardly tapering sidewalls 17, 18 of the dovetail groove 2 and held fast.

In order that the shavings produced during the planing of workpieces may be optimally removed, the wedging device 6 has on the side remote from the bottom 9 of groove 2 a depression 15. Bordering on a cutting edge 20 of the knife 5, the depression 15 has essentially a rounded shape with a radius R. This ensures excellent lifting and guidance of the shavings during machining of a workpiece.

The wedging device 6 shown in FIG. 3 includes two parallel bores 13 running at right angles to the contact surface 14 of the knife 5. In each of the bores 13 is a pin 8 projecting beyond the contact surface 14 by no more than the thickness of the knife 5. The knife 5, preferably of steel, tungsten carbide, or diamond, is lamella-shaped and has two opposite cutting edges 19, 20 and two continuous holes 12 in the flat. The holes 12 are spaced from one another by the same distance B as the pins 8 pressed into the bores 13 of the wedging device 6. The diameter of the holes 12 is slightly greater than that of the pins 8. For positioning the knife 5 roughly, its holes 12 are fitted on the protruding pins 8 so that one flat side of the knife 5 rests against the contact surface 14 of the wedging device 6. The knife-and-wedging device assembly thus formed is pushed, with the screw 7 slightly unscrewed, into one of the grooves 2 from one of the ends 3 or 4 and, as described earlier, braced against the sidewalls 17, 18 by driving in the screw 7. Each of the grooves 2 is fully outfitted by lining up such assemblies of wedging devices 6 and knives 5. In the embodiment illustrated, the knife 5 has two opposite cutting edges 19, 20. By rotating the knife 180 degrees, either the one edge 20 or the other 19 may be brought into operating position. As a modification, disposable knives 5 may be used. Expensive and time-consuming resharpening is thereby avoided.

Positioned on the planing tool depicted in FIG. 4 is a knife-aligning device 25 used to align the individual knives 5 in such a way that the cutting edges 20 all project evenly and by the same amount beyond the surface of the head 1. The device 25 comprises two brackets 30 (only one being shown in FIG. 4). One end of each bracket 30 is rotatingly connected to one of the journals 22, while a spindle 28 is rotatingly mounted between the other ends of the bracket 30. At one end of the spindle 28 is a handle 29 for turning it. One end of a guide component 26 engages a helical groove 31 running the length of the spindle 28, while the other, spatula-shaped end of the guide component 26 fits into one of the second grooves 16. Thus, when the spindle 28 is rotated, the guide component 26 moves along the length of the head 1 of the planing tool. An aligning wheel 27, rotatingly connected to the guide component 26 in a manner not visible in detail, aligns the individual knives 5 disposed in one of the grooves 2 with respect to the protrusion of the cutting edges 20 beyond the surface of the head 1.

FIG. 5 illustrates the manner in which the blind holes 10 in the bottoms 9 of two adjacent grooves 2 are staggered by half of the interval A. It is thereby achieved that the ends of the cutting edges of each of the knives ranged side by side are offset relative to one another in neighboring grooves 2. Owing to such offsetting, no traces of the individual knives are visible on the machined surface of a workpiece.

What is claimed is:

1. A planing tool for a woodworking machine, of the type having a substantially cylindrical head including at least a first helical groove of substantially dovetail cross-section extending from one end of the head to the other and having a bottom and two sidewalls, and at least one knife disposed in said first groove and having two flat sides, wherein the improvement comprises:

a plurality of blind holes spaced from one another longitudinally in said bottom of said first groove, a wedging device on which said knife can be disposed and pushed into said first groove from one end of said head together with said wedging device, said wedging device including a central bore, and a securing means disposable in said central bore and engageable with one of said blind holes for wedging said wedging device with said knife disposed thereon fast against said sidewalls of said first groove.

2. The planing tool of claim 1, wherein said knife includes two holes passing through said flat sides thereof, said wedging device including a contact surface for said knife, two parallel bores disposed at right angles to said contact surface, and two pins respectively disposed in said bores and projecting beyond said contact surface, said pins engaging said holes for positioning said knife.

3. The planing tool of claim 2, wherein said wedging device includes on the portion thereof remote from said bottom of said first groove a depression for shavings exhaustion.

4. The planing tool of claim 3, wherein said knife includes two opposite cutting edges and is so mounted that either of said cutting edges may project for machining a workpiece.

5. The planing tool of claim 4, wherein said knife is of diamond.

6. The planing tool of claim 4, wherein said knife is of tungsten carbide.

7. The planing tool of claim 4, wherein said knife is of steel.

8. The planing tool of claim 4, wherein said central bore of said wedging device includes a thread, said securing means comprising a headless screw provided with a shoulder matching said blind holes.

9. The planing tool of claim 1, further comprising a knife-aligning device having a guide component, and a second groove running parallel to said first groove for receiving said guide component.

10. The planing tool of claim 1, comprising a plurality of said first grooves and a plurality of said knives disposed in said first grooves, wherein said knives disposed in any two adjacent said first grooves are offset relative to one another by a predetermined distance.

* * * * *